US006892771B2

(12) United States Patent
Stocchi

(10) Patent No.: US 6,892,771 B2
(45) Date of Patent: May 17, 2005

(54) FILLING MACHINE

(75) Inventor: Gabriele Stocchi, Parma (IT)

(73) Assignee: STK Stocchi Progetti Srl, Parma (IT)

( * ) Notice: Subject to any disclaimer, the term of this patent is extended or adjusted under 35 U.S.C. 154(b) by 0 days.

(21) Appl. No.: 10/471,231

(22) PCT Filed: Feb. 5, 2002

(86) PCT No.: PCT/IB02/00346

§ 371 (c)(1),
(2), (4) Date: Sep. 9, 2003

(87) PCT Pub. No.: WO02/072466

PCT Pub. Date: Sep. 19, 2002

(65) Prior Publication Data

US 2004/0112460 A1 Jun. 17, 2004

(30) Foreign Application Priority Data

Mar. 14, 2001 (IT) ..... BO2001A0136

(51) Int. Cl.[7] ..... B65B 1/04
(52) U.S. Cl. ..... 141/129; 141/39; 141/144
(58) Field of Search ..... 141/39–43, 129, 141/144–152

(56) References Cited

U.S. PATENT DOCUMENTS 3,166,107 A * 1/1965 Swenson et al. ..... 141/145
3,207,189 A * 9/1965 Vergobbi ..... 141/90
3,946,770 A 3/1976 Trinne et al.
4,442,873 A 4/1984 Yun
5,944,071 A * 8/1999 Tietz et al. ..... 141/145
6,474,368 B2 * 11/2002 Clusserath et al. ..... 141/6

FOREIGN PATENT DOCUMENTS

DE 10 76 518 2/1960
DE 12 48 498 8/1967

* cited by examiner

*Primary Examiner*—Steven O. Douglas
(74) *Attorney, Agent, or Firm*—Oblon, Spivak, McClelland, Maier & Neustadt, P.C.

(57) ABSTRACT

Improvements to isobaric aseptic filling machines are related to processing fluids that are not contained in a rotating tank but in a fixed tank. Such improvements also include a number of coil tubes generating high flow resistance during the filling phase of the process fluid.

9 Claims, 9 Drawing Sheets

FILLING MACHINE

TITLE OF THE INVENTION

Background of the Invention (1) Field of the Invention

The present invention concerns bottling plants, especially for gassed liquids. International classification B67g.

(2) Description of Related Art

Bottling plants with filling machines equipped with rotating tanks are already known.

The following problems still need be solved:

- realizing simplified filling machines without rotating tanks;
- modulating the filling process with a starting transitory phase at increasing filling speed and a final transitory phase at decreasing final phase;
- discharging of gas and residuals through conduits separated by the processing fluids in order to avoid bacterial contamination;

The filling machines presented in this invention solves all the problems mentioned above proposing an extremely simple and affordable realization, together with a high operating reliability.

DESCRIPTION

The invention is now disclosed in details, referring to the attached drawings as a not restrictive example.

FIG. 1 represents a general scheme of the filling machine. It can be observed the presence of an external fixed tank (1) containing the processing fluids (liquid and gas) at pressure P1. It can also be noticed that the filling machine lacks a main rotating tank, but is only provided with three rotating manifolds (2, 3, 13). FIG. 1 bis shows more in detail the connection of the rotating filling machine with the fixed tank (1) through the conduit (11) for the liquid and the conduit (12) for the gas. The following points must be noticed:

- in the rotating manifold 13) the liquid is always at pressure P1;
- in the rotating manifold (2) the gas is always at operating pressure P1;
- in the rotating manifold (3) the liquid is always at lower pressure P2;

It should be noticed that the difference of pressure between manifolds (2) and (3) can be controlled through the pressure reducing valve (4).

FIG. 2 shows in details the pressurizing phase of the bottle (9). One can notice that the valve (5) is open and that the gas enters to fill the bottle at pressure P1. It can also be noticed that valves (6) and (7) are closed.

FIG. 3 bis and its detail FIG. 3 show that the valve (7) is open, but the liquid at pressure P1 cannot move into the bottle because this is filled with the processing gas at the same pressure P1. It can also be noticed that the valve (6) is closed and that the gas and the residual air remain inside at pressure P1.

In FIG. 4 it can be noticed that after closing valve (5) and opening valve (6) the gas moves towards the rotating manifold (3) and this makes the pressure inside the bottle decrease as schematically described in FIG. 6 diagram.

BRIEF SUMMARY OF THE INVENTION

Improvements to isobaric aseptic filling machines relate to processing fluids that are not contained in a rotating tank but in a fixed tank. Such improvements also include a number of coil tubes generating high flow resistance during the filling phase of the process fluid. As such, an isobaric filling machine for filling bottles is disclosed including, among other features, a fixed tank containing processing fluids and a rotating manifold connected to the fixed tank and adapted to fill the processing fluids into the bottles, wherein the fixed tank contains a gas and a liquid at a first pressure.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

As the pressure inside the bottle starts decreasing from P1 to P2, the filling phase starts, because the liquid is now at higher pressure than the bottle's pressure.

Then, as the gas pressure continues to decrease, the liquid inflow speed increases since the pressure difference causing the filling process has increased. However, the coil tube (8) generates a flow resistance that is function of the speed as shown in the FIG. 7 diagram.

Figure 8:
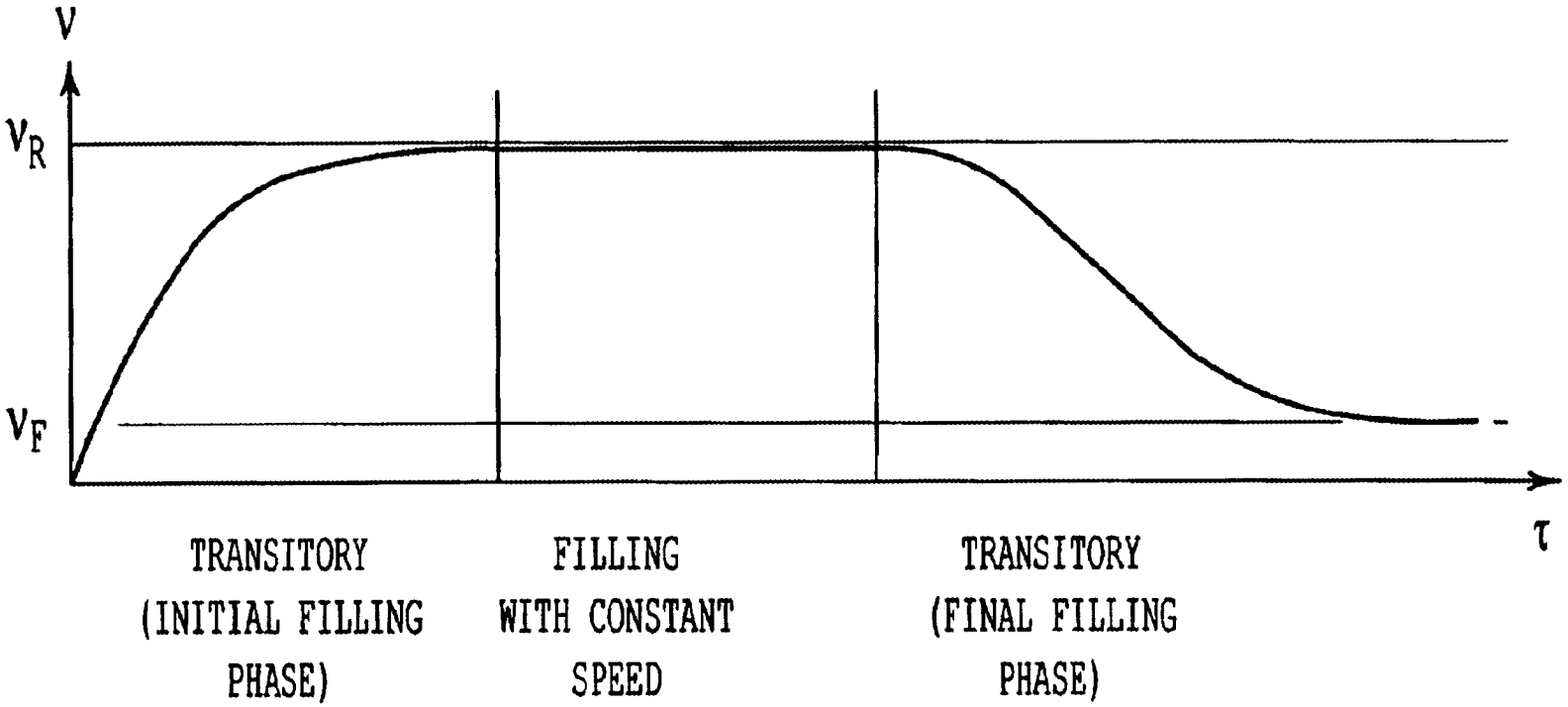
FIG. 8 is an illustration of the variation in filling speed as a result of the characteristics shown in FIGS. 6 and 7.

After the starting transitory phase, the filling phase of the liquid stabilizes at speed value in which the flow resistance equals the difference between pressure P1 and P2, as schematically shown in FIG. 8 diagram.

Figure 1A:
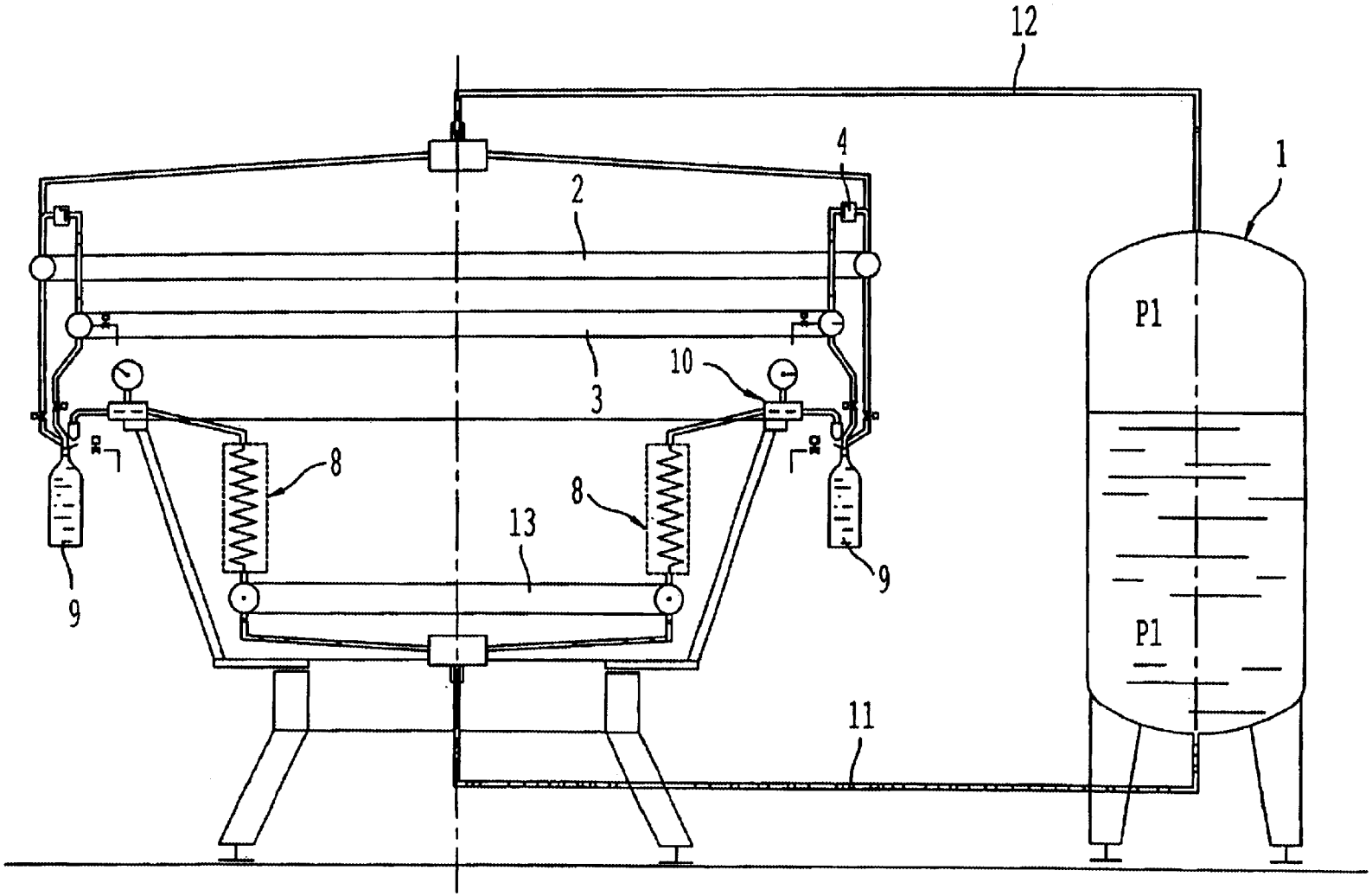
FIG. 1 is an illustration of an embodiment of the filling machine of the instant invention.
Figure 1B:
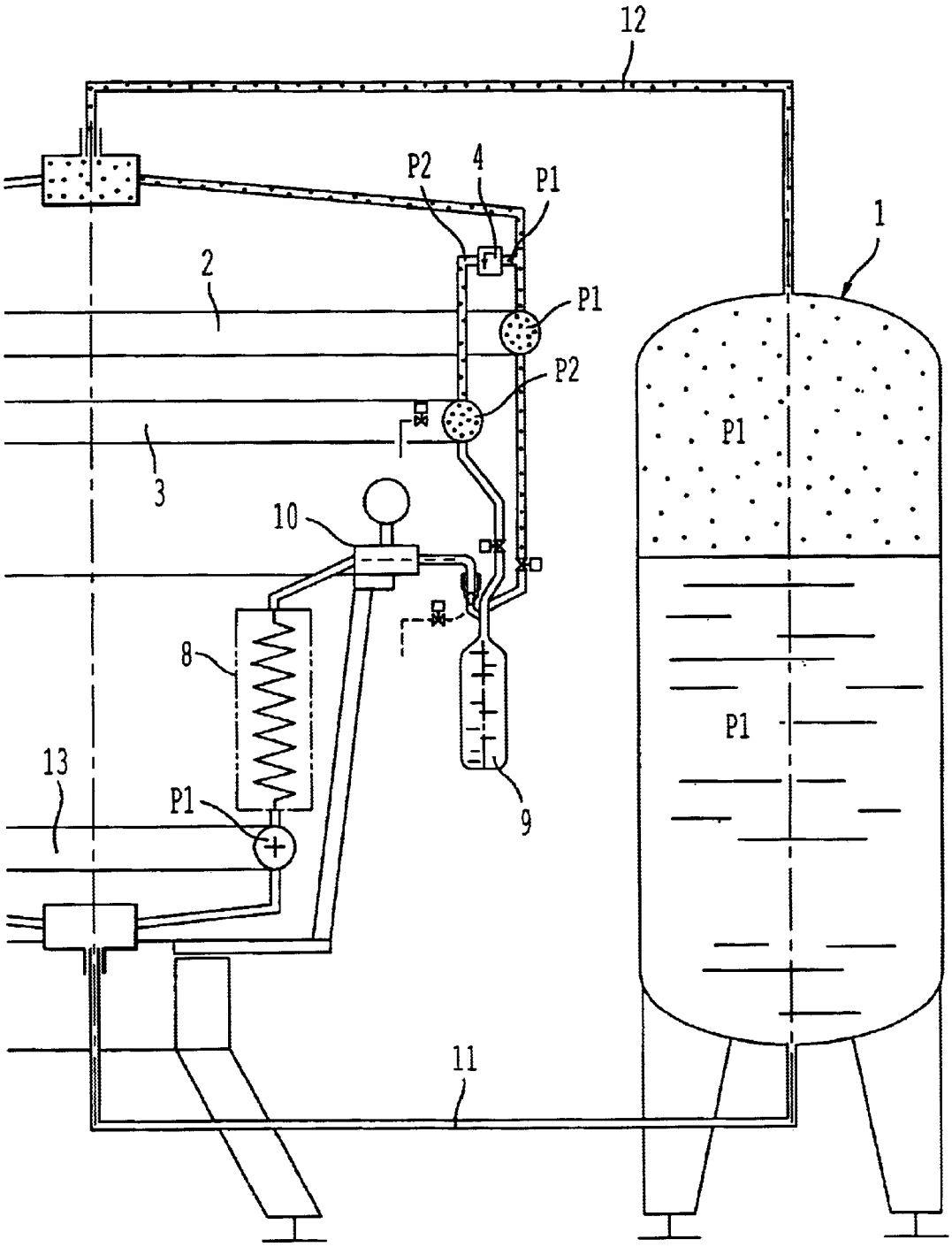
Figure 2:
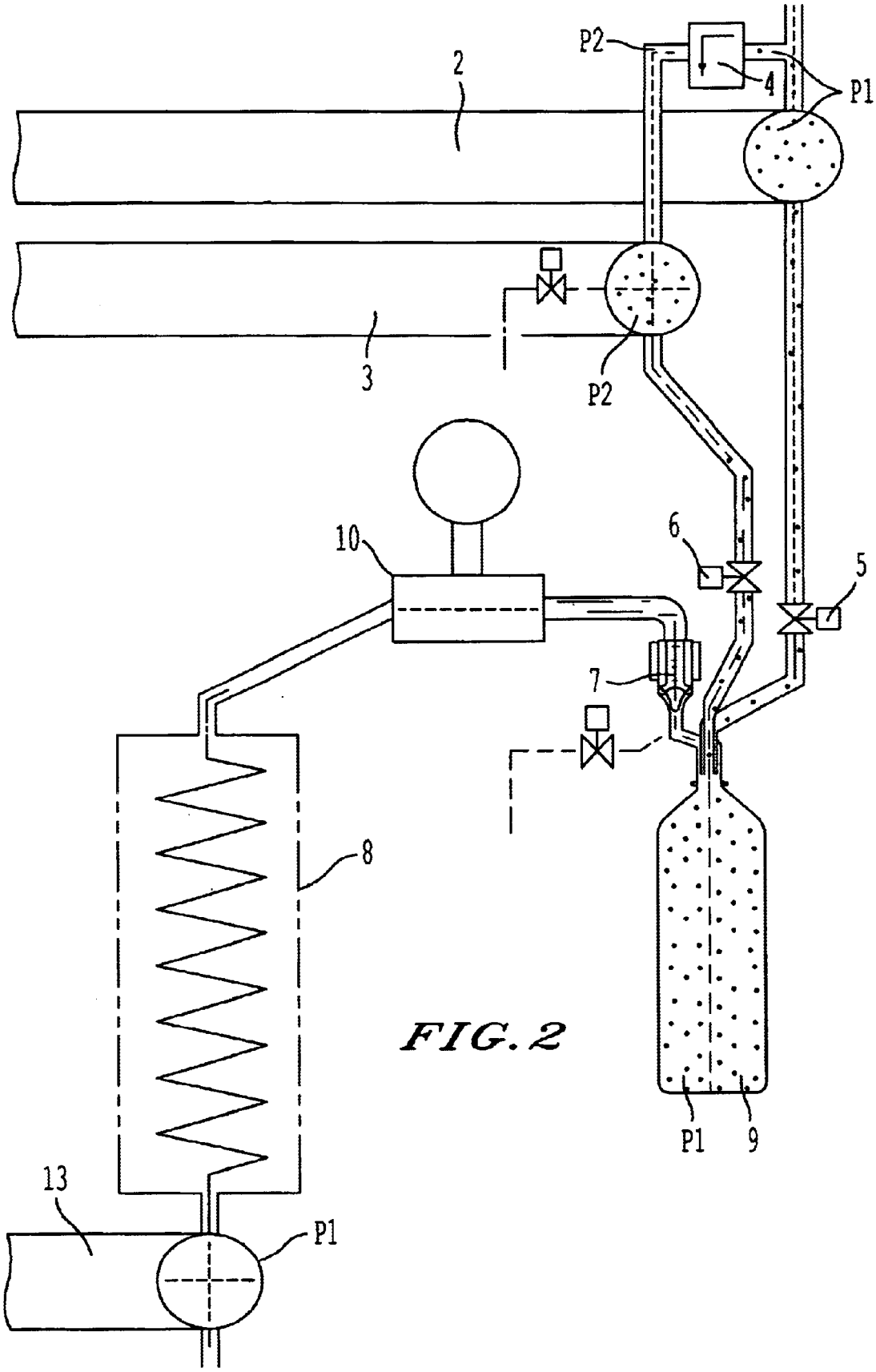
FIGS. 2–5 are illustrations of different phases during a bottle filling process utilizing the instant invention.
Figure 3A:
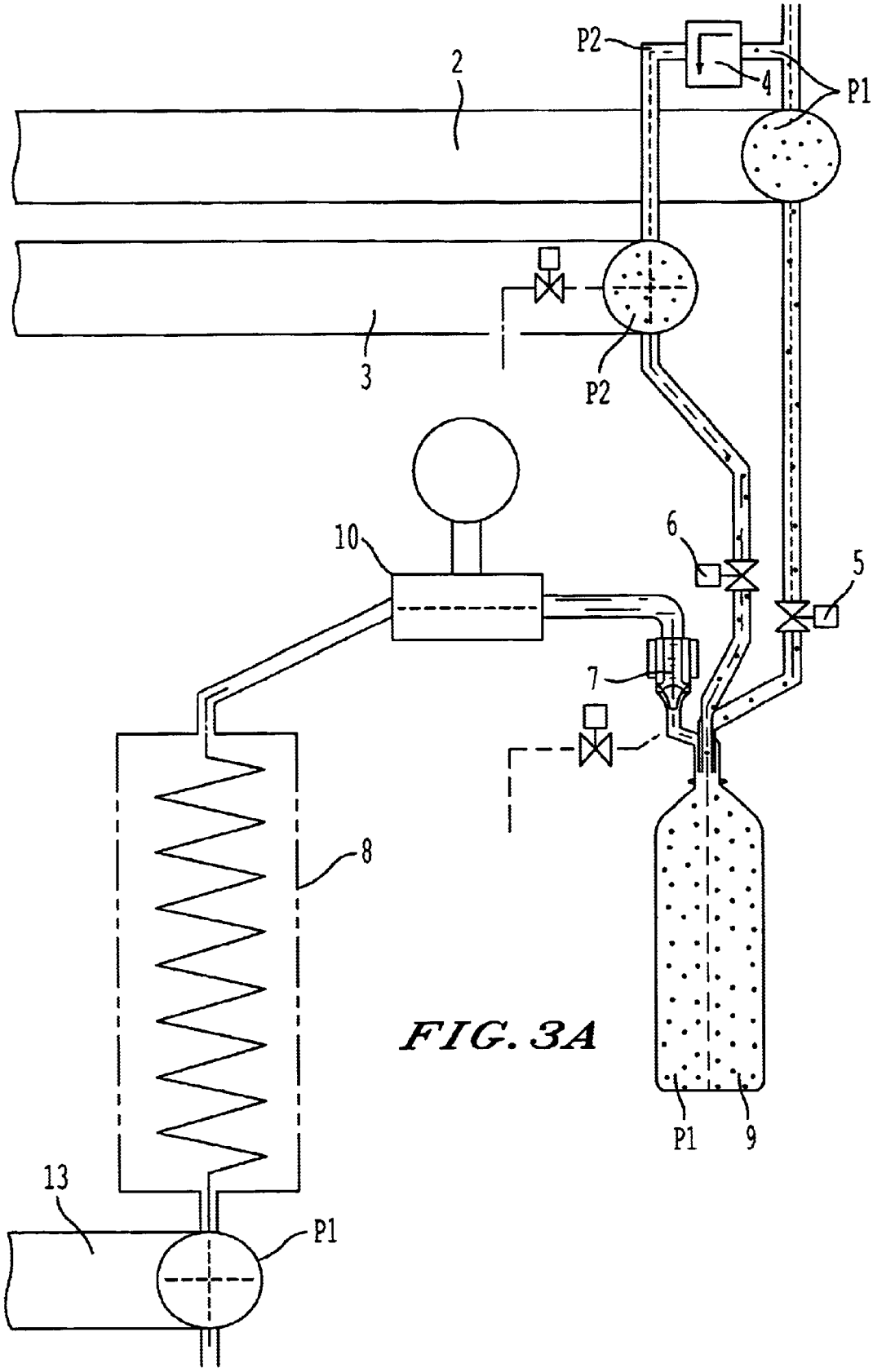
Figure 3B:
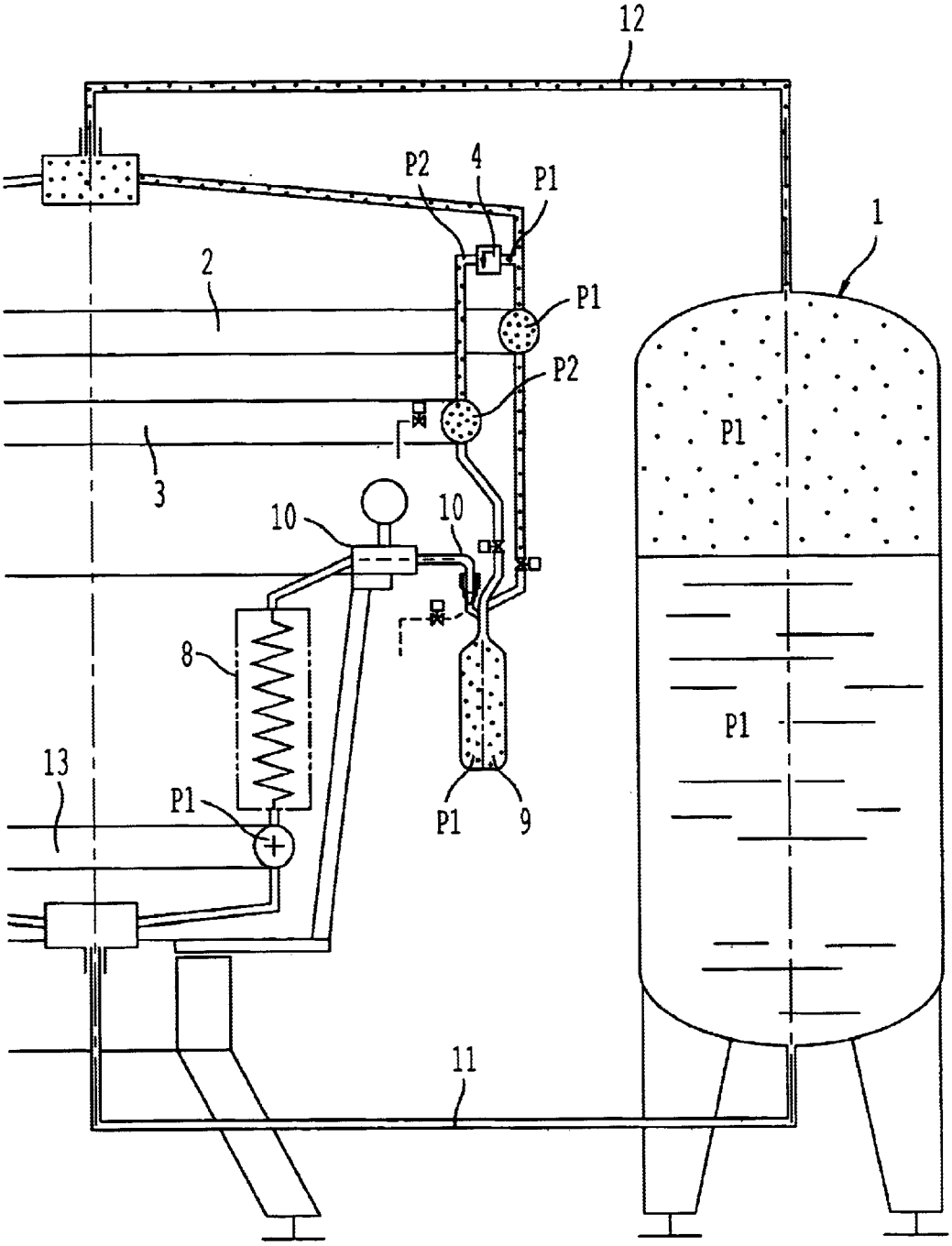
Figure 4:
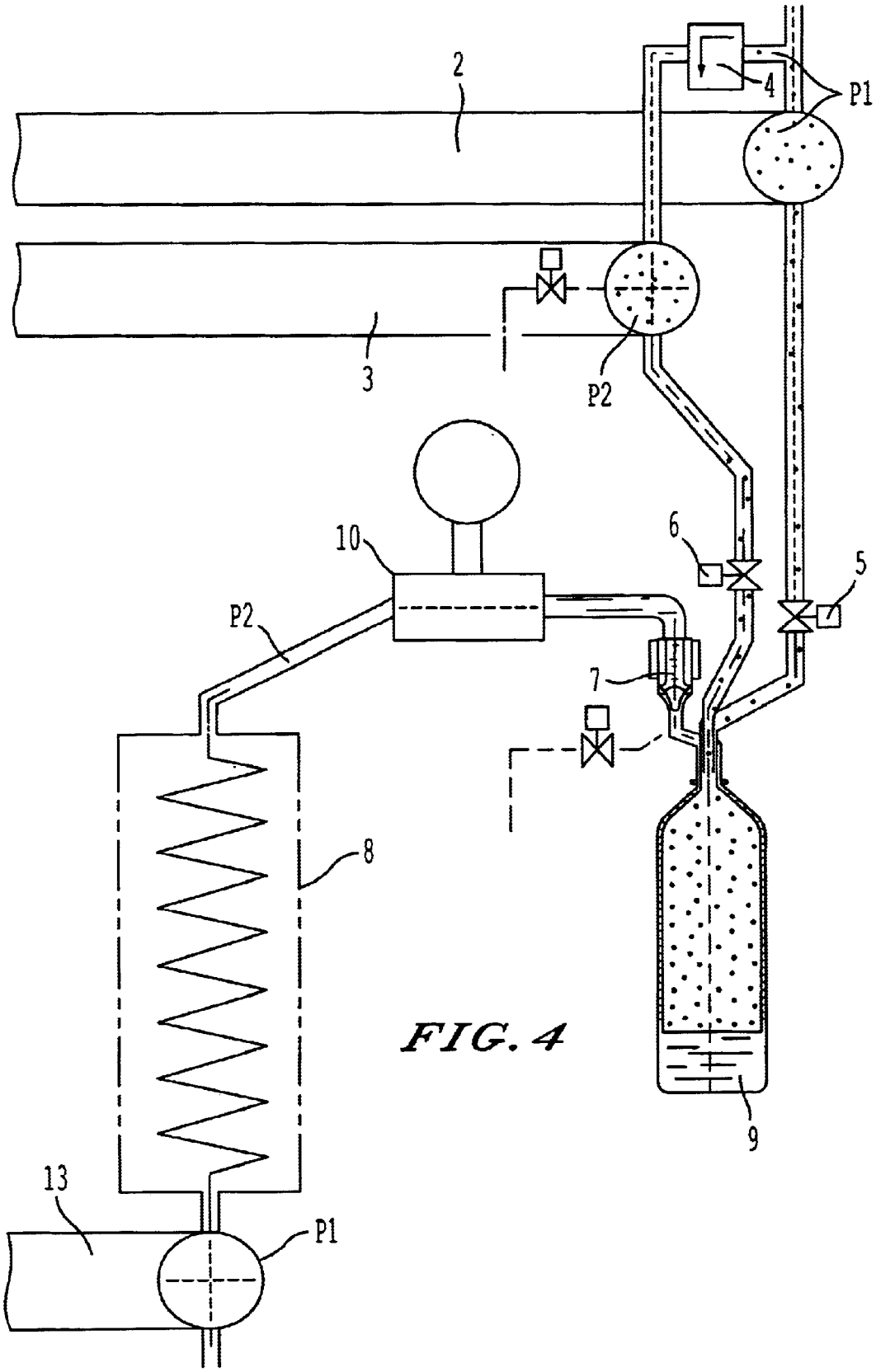
Figure 5:
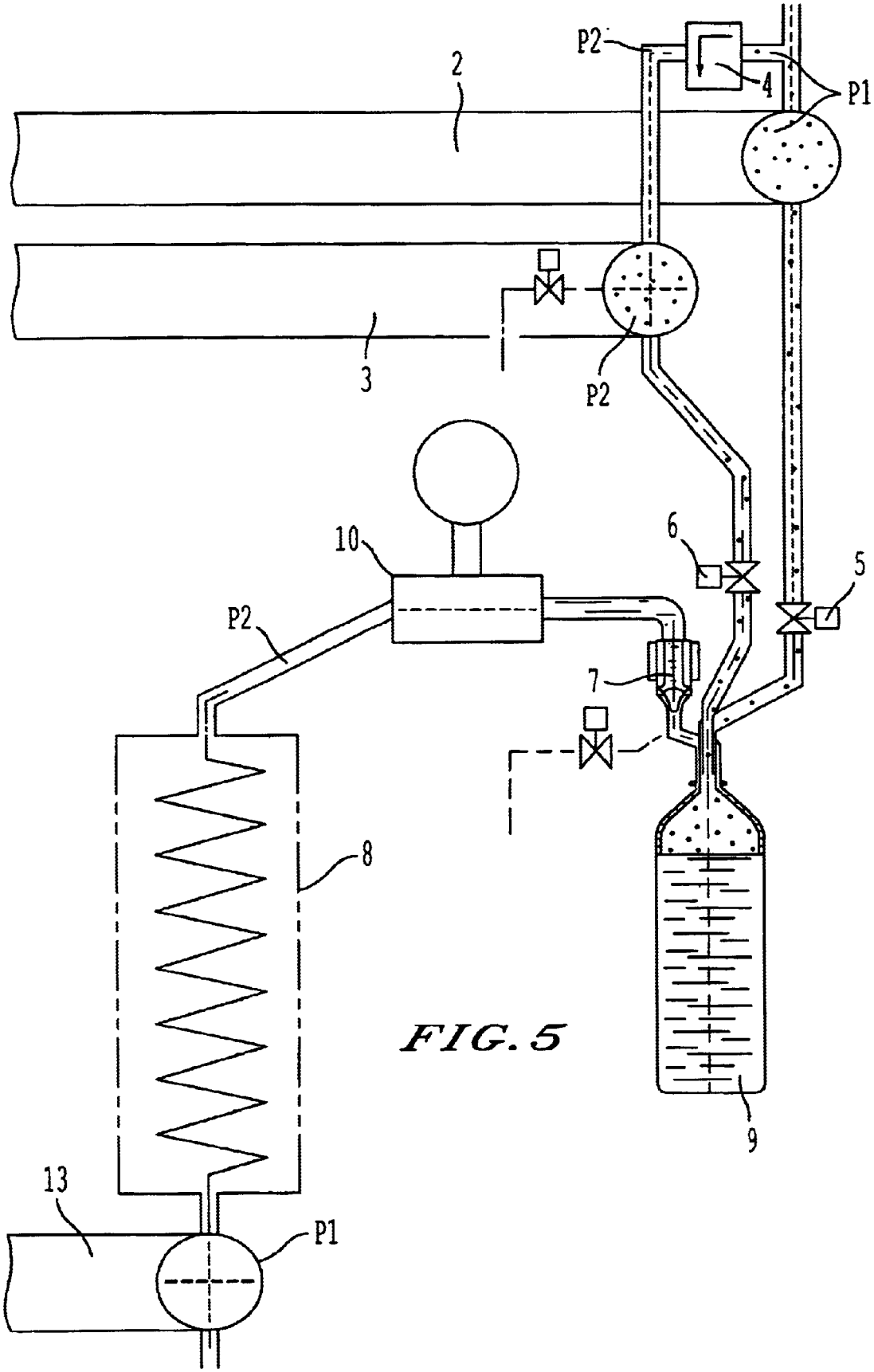

FIG. 5 shows the final transitory phase of the filling process. It can be noticed that valve (5) is open such as valve (6). In this phase, the gas at pressure P1 enters the bottle's neck while the gas inside the bottle flows out through valve (6). Inside the bottle the pressure rises and tends to stabilize at an intermediate level between P1 and P2. This pressure increment inside the bottle slows down the filling speed as schematically shown in FIG. 8 diagram.

Figure 6:
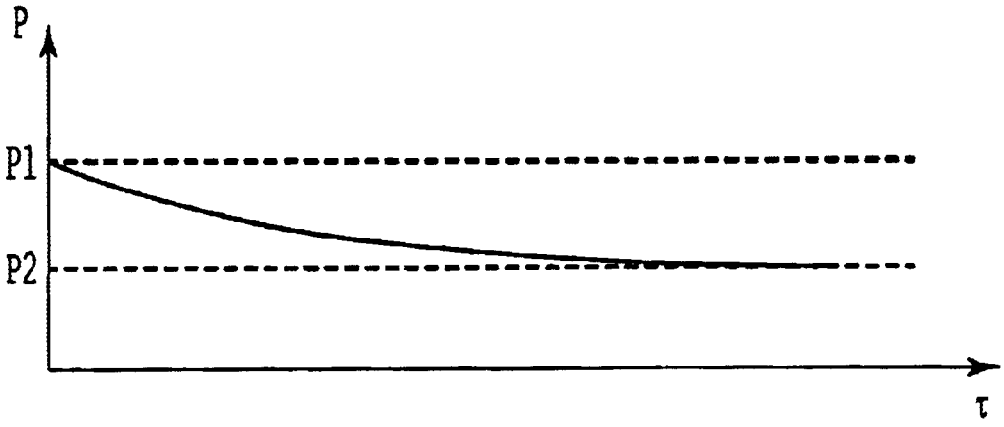
FIG. 6 is an illustration of the variation of pressure as a function of time from P1 to P2.

In FIG. 6 is schematically shown the gradual pressure decrement as a function of time from value P1 to P2.

Figure 7:
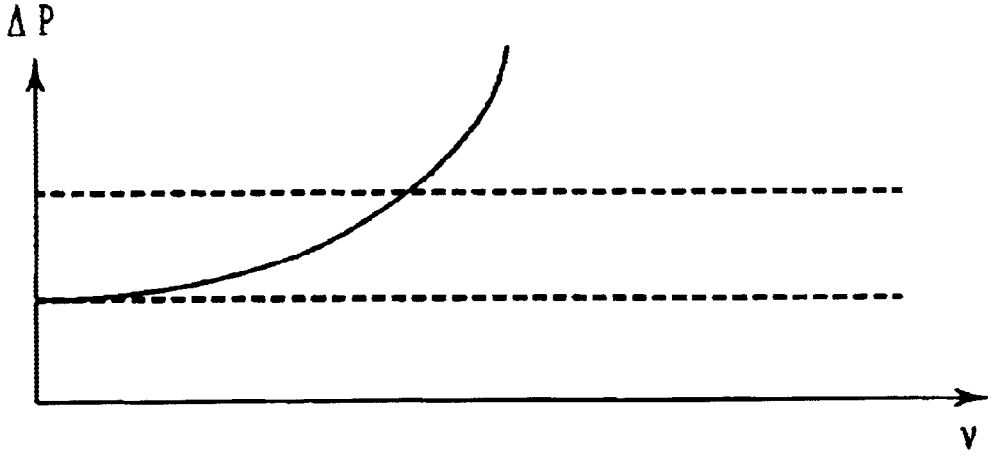
FIG. 7 is an illustration of the variation of flow resistance inside of a coil tube as a function of outflow speed.

In FIG. 7 is schematically shown the flow resistance increment inside the coil tube (8) as a function of the outflow speed.

FIG. 8 indicates the filling speed as a result of the characteristics shown in FIGS. 6 and 7.

It can be noticed that during the initial transitory phase the speed increases until it reaches a constant value and in the final transitory phase it decreases to a lower final value.

In the figures each single detail of the plant is marked as follows:

1 indicates the fixed tank containing the processing fluids at P1 pressure.

2 indicates a rotating manifold containing the processing gas at P1 pressure.

3 indicates a rotating manifold containing the processing gas at lower P2 pressure.

4 indicates a device to reduce the pressure from value P1 to P2.

5 indicates a gas intercepting valve between bottle (9) and manifold (2).

6 indicates a gas intercepting valve between bottle (9) and manifold (3).

7 indicates the valve that intercepts the filling liquid.

8 indicates the coil tube that generates the flow resistance.

9 indicates the bottle to be filled.

10 indicates a flow meter.

11 indicates a connecting conduit of the liquid between the fixed tank (1) and the rotating manifold (13).

12 indicates a connecting conduit of the gas between the fixed tank (1) and the rotating manifold (2).

13 indicates a rotating manifold that distributes the liquid to the different filling valves.

The figures clearness highlights the functional characteristics of the improved plant. These improvements can of course be realized according to different structural proportioning and to the technical choices that best suit the specific requirements of the bottling plants.

All the isobaric filling machines that present the same features as the ones described, shown and hereinafter claimed will be considered as part of the protection sphere of this invention.

What is claimed is:

1. An isobaric filling machine for filling bottles, comprising:

a fixed tank containing processing fluids; and a rotating manifold directly connected to the fixed tank, said rotating manifold being adapted to fill the processing fluids into said bottles, wherein the fixed tank contains a gas and a liquid at a first pressure.

2. The isobaric filling machine of claim 1, wherein said rotating manifold further comprises a first rotating manifold for filling said gas at said first pressure into said bottles and a second rotating manifold for filling said liquid at said first pressure into said bottles.

3. The isobaric filling machine of claim 2 further comprising:

a third rotating manifold connected to the fixed tank via a pressure reducing valve at a second pressure lower than said first pressure.

4. The isobaric filling machine of claim 1, wherein outlets of said rotating manifold are connected to each other via respective intercepting valves.

5. The isobaric filling machine of claim 3, wherein, at an initial state of a bottle filling process, a first valve connected to said first rotating manifold is initially opened, a second valve connected to said second rotating manifold is initially closed, and a third valve connected to said third rotating manifold is initially closed, such that the bottle is initially filled with the gas at the first pressure.

6. The isobaric filling machine of claim 5, wherein, after filling the bottle with gas, said first valve is closed and said second and third valves are opened, such that the pressure in the bottle is thereafter reduced to the second pressure so as to allow an entering of fluid at said first pressure into said bottle.

7. The isobaric filling machine of claim 6, wherein the second rotating manifold further comprises a coil tube configured to generate a flow resistance so as to stabilize a filling speed of the liquid into the bottle.

8. The isobaric filling machine of claim 7, wherein, at a final stage of the bottle filling process, said first valve is opened such that said gas at said first pressure flows into said bottle so as to slow down the filling speed.

9. An isobaric filling machine for filling bottles, comprising:

a fixed tank containing processing fluids; and a rotating manifold connected to the fixed tank without another tank connected there between, said rotating manifold being adapted to fill the processing fluids into said bottles, wherein the fixed tank contains a gas and a liquid at a first pressure.

* * * * *